US007197902B1

(12) United States Patent
Barkdoll

(10) Patent No.: US 7,197,902 B1
(45) Date of Patent: Apr. 3, 2007

(54) DISPLAY LOCK SYSTEM

(75) Inventor: Patrick J. Barkdoll, Pecatonica, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 11/287,724

(22) Filed: Nov. 28, 2005

(51) Int. Cl.
*E05B 65/00* (2006.01)

(52) U.S. Cl. ..... 70/57.1; 248/220.31; 211/7; 211/57.1

(58) Field of Classification Search ..... 70/57.1, 70/58, 62; 211/7, 8, 54.1, 57.1, 59.1; 248/220.21, 248/220.22, 220.31, 220.41, 222.51
See application file for complete search history.

(56) References Cited

U.S. PATENT DOCUMENTS

| | | | | |
|---|---|---|---|---|
| 1,755,927 A | | 4/1930 | Levinsohn | |
| 3,622,011 A | | 11/1971 | Snow | |
| 4,027,798 A | | 6/1977 | Swaim | |
| 4,063,646 A | | 12/1977 | Stahl, Jr. | |
| 4,223,542 A | * | 9/1980 | Basseches | 70/58 |
| 4,289,242 A | | 9/1981 | Kenyon | |
| 4,394,909 A | | 7/1983 | Valiulis et al. | |
| 4,756,504 A | * | 7/1988 | Chamberlain | 248/552 |
| 4,850,557 A | | 7/1989 | Valiulis | |
| 5,009,334 A | | 4/1991 | Bodkins | |
| 5,027,622 A | | 7/1991 | Hatch et al. | |
| 5,259,220 A | | 11/1993 | Fredrickson | |
| 5,275,027 A | | 1/1994 | Eklof et al. | |
| 5,597,150 A | | 1/1997 | Stein et al. | |
| 5,624,040 A | * | 4/1997 | Hono | 211/4 |
| 5,671,851 A | | 9/1997 | Johnson et al. | |
| 5,676,258 A | * | 10/1997 | Leyden et al. | 70/58 |
| 5,689,978 A | * | 11/1997 | Eklof et al. | 70/62 |
| 5,711,432 A | | 1/1998 | Stein et al. | |

(Continued)

FOREIGN PATENT DOCUMENTS

| | | |
|---|---|---|
| WO | WO 03/080972 | 10/2003 |

OTHER PUBLICATIONS

Trion advertisement, "New ScanLock Cuts Theft"; Trion Industries, Inc., 297 Laird Street, Wilkes-Barre, Pennsylvania 18702-6997, Phone: 800.444.4665, Fax: 570.823.4080, info@triononline.com, www.triononline.com.

*Primary Examiner*—Suzanne Dino Barrett
*Assistant Examiner*—Christopher Boswell
(74) *Attorney, Agent, or Firm*—Reinhart Boerner Van Deuren P.C.

(57) ABSTRACT

A display lock is provided. The display lock is adapted to selectively secure merchandise on a display hook. The display hook having at least two bars. The display lock comprising a lock body, an arm and a clasp. The lock body having a locking mechanism. The arm having a first end hingedly connected to an upper portion of the lock body and a second end adapted to mate with a lower portion of the lock body. The arm having a catch portion engageable with the locking mechanism. The display lock having a locked position in which the arm is mated with lock body and engaged with the locking mechanism. The display lock further having an unlocked position in which the second end is not mated with the lock body. The clasp connected to at least one of the lock body and the arm and being adapted to mount the display lock to the display hook.

22 Claims, 5 Drawing Sheets

U.S. PATENT DOCUMENTS 6,003,685 A * 12/1999 Malin ..... 70/62
6,364,124 B1 * 4/2002 Chen ..... 211/4
6,393,877 B1 5/2002 Church
6,474,478 B1 11/2002 Huehner et al.
6,598,433 B1 * 7/2003 Malvasio ..... 70/58
6,622,979 B2 * 9/2003 Valiulis ..... 70/57.1
6,659,291 B2 12/2003 Huehner et al.
6,957,555 B1 10/2005 Nagel et al.
2004/0026344 A1 * 2/2004 Sedon et al. ..... 211/7
2004/0084386 A1 * 5/2004 Huehner et al. ..... 211/4
2006/0157431 A1 * 7/2006 Nagelski et al. ..... 211/54.1

* cited by examiner

DISPLAY LOCK SYSTEM

FIELD OF THE INVENTION

This invention generally relates to an inventory display system, and more particularly to an inventory display lock for use with display hooks that are attached to a peg board for holding and displaying merchandise at a retail establishment.

BACKGROUND OF THE INVENTION

There are a variety of different types of display hooks that are presently in wide use. One type of display hook is a "scanner hook" of the type disclosed in U.S. Pat. No. 4,452,360 to Barnes. The scanner hook includes a lower horizontally extending hanger arm for supporting merchandise and an upper parallel arm for supporting a label that includes a price tag which may be "read" by an electronic scanning wand.

Unfortunately, these display hooks by themselves provided little or no theft deterrence to shoplifters. Particularly, shoplifters will steal product by a method know as sweeping. The shoplifter will "sweep" the entire product supported by the lower hanger arm from the display hook in a single motion into a container such as a purse or bag. This method of shoplifting occurs very quickly and results in a significant loss of product. Security display locks have been developed to prevent sweeping by securing or locking the merchandise on the display hook. Such display locks include U.S. Pat. No. 6,957,555 to Nagel et al., U.S. Pat. No. 6,393,877 to Church, U.S. Pat. No. 5,275,027 to Eklof et al., and U.S. Pat. No. 5,027,622 to Hatch et al. The present invention relates to improvements in display locks as it relates to theft prevention, reliability, adaptability, practicality, ease-of-use, and/or cost effectiveness.

BRIEF SUMMARY OF THE INVENTION

In one aspect, the invention provides a display lock for selectively securing merchandise on a display hook. The display lock includes a clasp, a first member, a second member and a lock. The clasp is adapted to mount the display lock to the display hook. The first member includes a first engagement portion. The second member is pivotally connected to the first member by a hinge and includes a second engagement portion adapted to mate with the first engagement portion of the first member. The first member pivots relative to the second member through the hinge between a closed position in which the first and second engagement portions mate and an open position in which the first and second engagement portions are unmated. The lock having a locked condition maintaining the first and second engagement portions in the closed position and having an unlocked condition permitting relative movement of the first and second members to the open position.

In another aspect, the invention provides a display lock for securing merchandise on a display hook. The display hook having at least two bars. The display lock comprising a lock body, an arm and a clasp. The lock body having a locking mechanism. The arm having a first end hingedly connected to an upper portion of the lock body and a second end adapted to mate with a lower portion of the lock body. The arm having a catch portion engageable with the locking mechanism. The display lock having a locked position in which the arm is mated with lock body and engaged with the locking mechanism. The display lock further having an unlocked position in which the second end is not mated with the lock body. The clasp connected to at least one of the lock body and the arm and being adapted to mount the display lock to the display hook.

In yet another aspect, the invention provides a display lock system for securely displaying merchandise. The display lock system including a support, a display hook and a display lock. The display hook comprising a rear mount configured to attach the display hook to the support and at least two bars extending forwardly from the rear mount. The at least two bars including a top bar and a bottom bar. The bottom bar parallel to and vertically disposed under the top bar. The top bar further including a stop disposed on the top bar. The display lock comprising a clasp, a lock body, and an arm. The clasp being disposed on the top bar. The lock body including a locking mechanism. The arm connected to and movable relative to the lock body. The arm having a catch engaged with the locking mechanism in a locked position and the catch being disengaged from the locking mechanism in an unlocked position. In the locked position the arm being generally positioned on a first side of the upper and lower bars and the lock body being positioned on a second side of the upper and lower bars being opposite the first side. The lock body and arm entrapping the upper and lower bars therebetween in the locked position.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
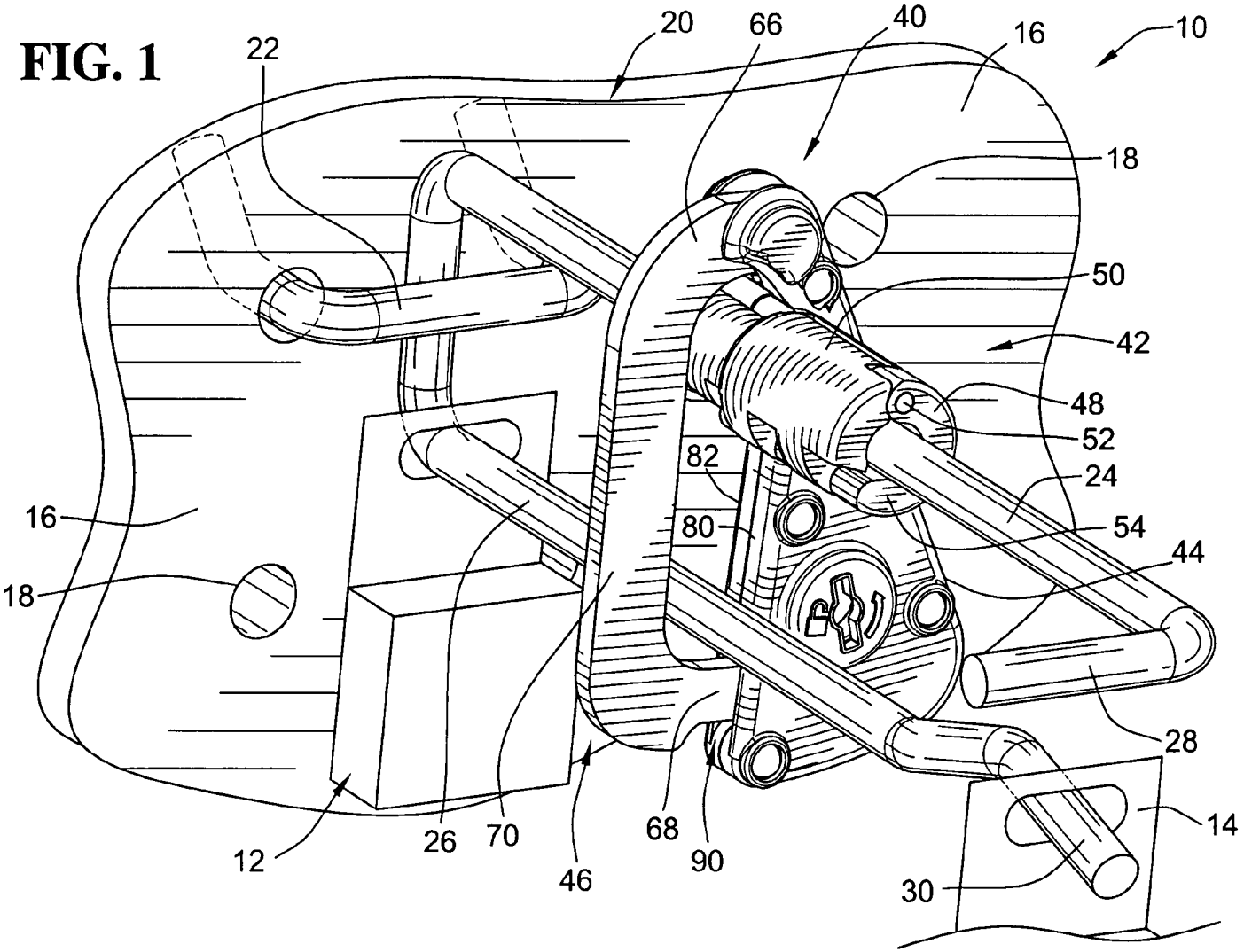
FIG. 1 is a perspective view of an exemplary embodiment of a display lock system having a display lock attached to a display hook and the display lock being in an locked position.

An exemplary embodiment of a display lock system 10 in accordance with this invention is shown in FIG. 1. The display lock system 10 is used to securely display merchandise 12, 14 for sale to customers in retail establishments.

The display lock system 10 includes a vertical support in the form of a peg board 16 having numerous apertures 18. A display hook 20 for carrying the merchandise 12, 14 is mounted to and extends in a forward direction from the peg board 16. The display hook 20 has a rear mount 22 adapted to selectively attach the display hook 20 to the apertures 18 of the peg board 16. The display hook 20 includes a top bar 24 and a bottom bar 26 extending in a forward direction from the rear mount 22. The top bar 24 being vertically displaced above and generally parallel to the bottom bar 26. Typically, the top and bottom bars 24, 26 are formed from a single piece of metal rod or wire that is bent into a generally U-shaped member. The front end of the top bar 24 terminates in a stop 28 configured for attaching a sign holder. In the illustrated embodiment, the stop 28 is a bend in the free end of the top bar 24. Alternatively, the stop could be a piece of rod configured to receive a sign holder or it could be a sign holder secured directly to the top bar. The front end of the bottom bar 26 terminates in a bent free end 30. The bottom bar 26 carries the displayed merchandise 12, 14 and the bent free end 30 helps retain the merchandise 12, 14 on the bottom bar 26.

The display lock system 10 further includes a display lock 40 mounted to the top bar 24 of the display hook 20 between the rear mount 22 and the stop 28. The display lock 40 is used to secure merchandise to the display hook 20. In one application of the display lock 40, the display lock 40 is used to selectively secure the rear portion of the merchandise 12 to the bottom bar 26 of the display hook between the rear mount 22 and the display lock 40, while the forward portion of merchandise 14 in front of the display lock 40 is free to be removed from the bottom bar 26. Alternatively, the display lock 40 may be used to secure all of the merchandise to the display hook.

The display lock 40 generally includes a clasp 42; two members which are pivotal relative to each other which may take the form of a lock body 44 and a securing arm 46; and some form of a lock 92 as shown in FIGS. 1–4. The clasp 42 attaches the display lock 40 to the top bar 24 of the display hook 20. The clasp 42 may or may not grip or snuggly fit on the top bar 24. The clasp 42 extends in a forward direction from the lock body 44 and is disposed below the location where the securing arm 46 is pivotally connected to the lock body 44. In the preferred embodiment, the clasp 42 includes a first C-shaped member 48 and a second C-shaped member 50. However, it will be appreciated the clasp may also comprise a single member with an aperture or groove that receives the top bar. The first C-shaped member 48 extends in a forward direction from and is integrally attached to the front of the lock body 44. It will be appreciated that the clasp could alternatively be attached to and/or integrally connected to the securing arm rather than the lock body 44. The second C-shaped member 50 is hingedly attached to the first C-shaped member 48 via hinge pin 52 inserted through holes 53 of the C-shaped members 48, 50.

Figure 2:
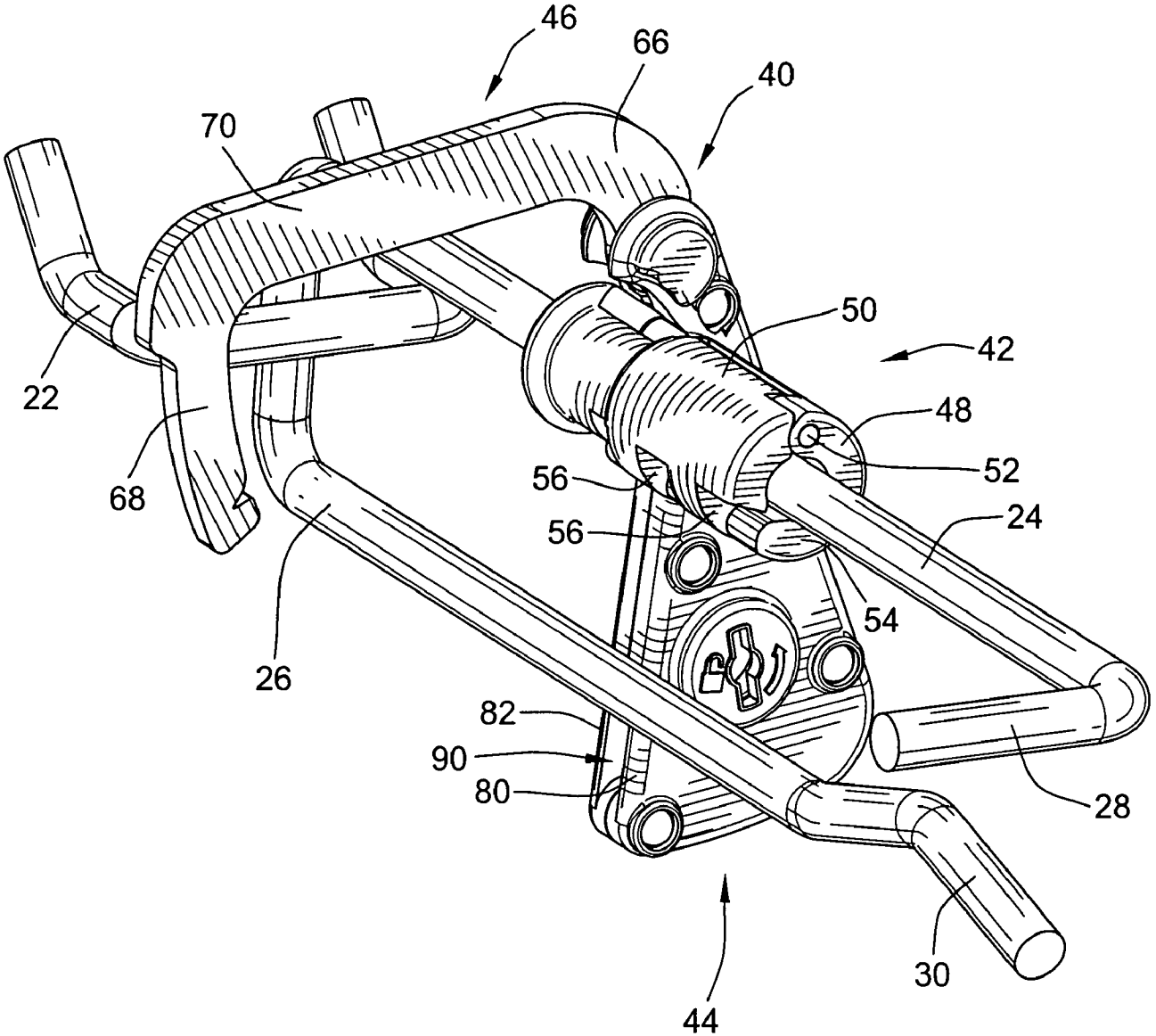
FIG. 2 is a perspective view of the display lock system similar to FIG. 1 wherein the display lock is in an unlocked position.

The second C-shaped member 50 pivots relative to the first C-shaped member via hinge pin 52 such that the C-shaped members 48, 50 define an open position (FIG. 3) and a closed position (FIGS. 1 and 2). In the closed position (FIGS. 1 and 2), an aperture is defined between the C-shaped members 48, 50. The aperture is sized to pivotally and slidably receive the top bar 24 therein.

In the preferred embodiment, the first C-shaped member 48 includes a first set of fingers 54 at a bottom portion thereof, and the second C-shaped member 50 includes a second set of fingers 56 at a bottom portion thereof that mesh with the first set of fingers 54 while the first and second C-shaped members 48, 50 are in the closed position. These interlocking fingers 54, 56 help hold the second C-shaped member 50 in the closed position relative to the first C-shaped member 48. Consequently, it is preferred that the fingers 54, 56 of the C-shaped members 48, 50 should be sized such that the fingers 54, 56 mesh with a friction fit.

Figure 3:
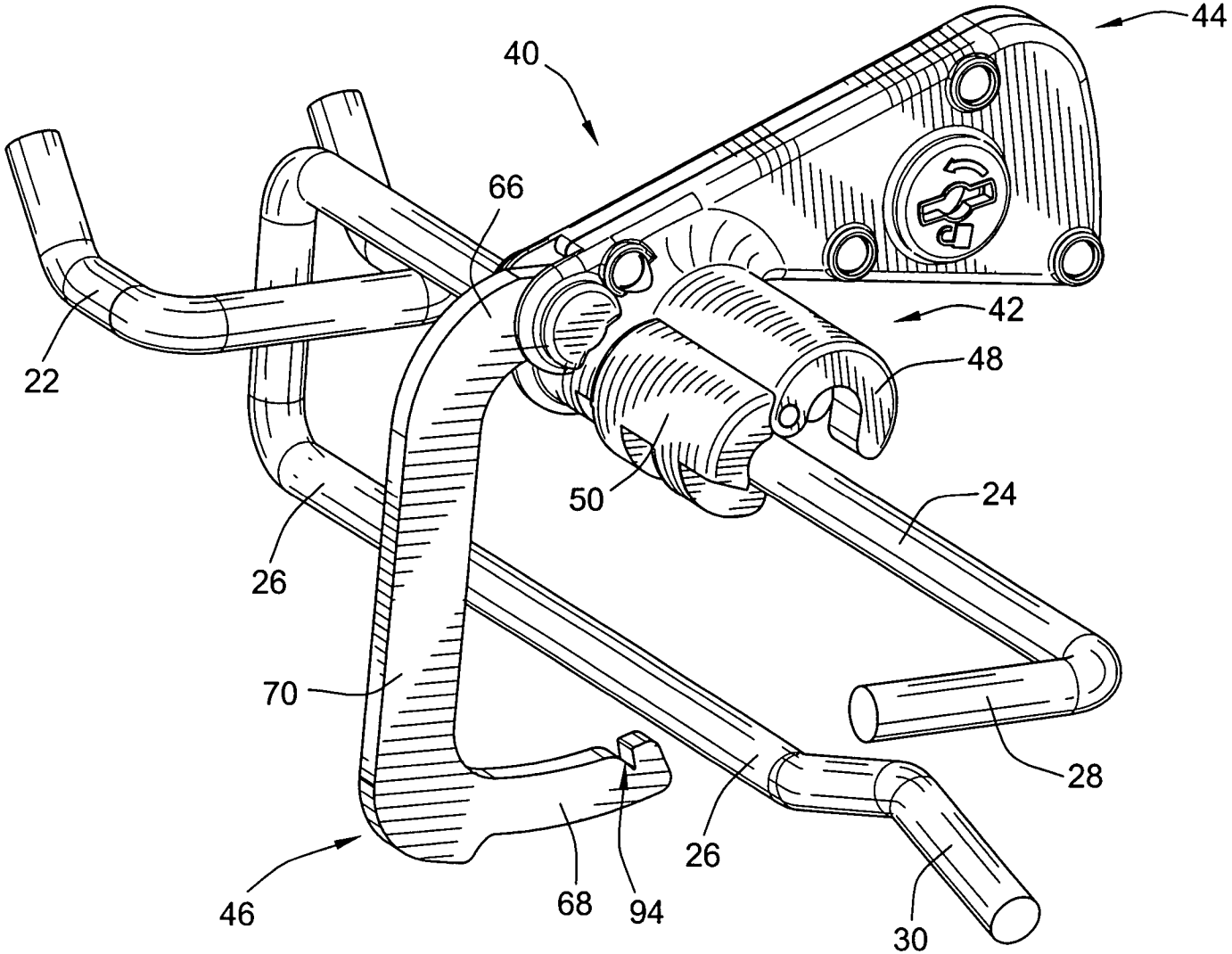
FIG. 3 is a perspective view of the display lock system similar to FIG. 1 illustrating how the display lock is attached to the display hook.
Figure 4:
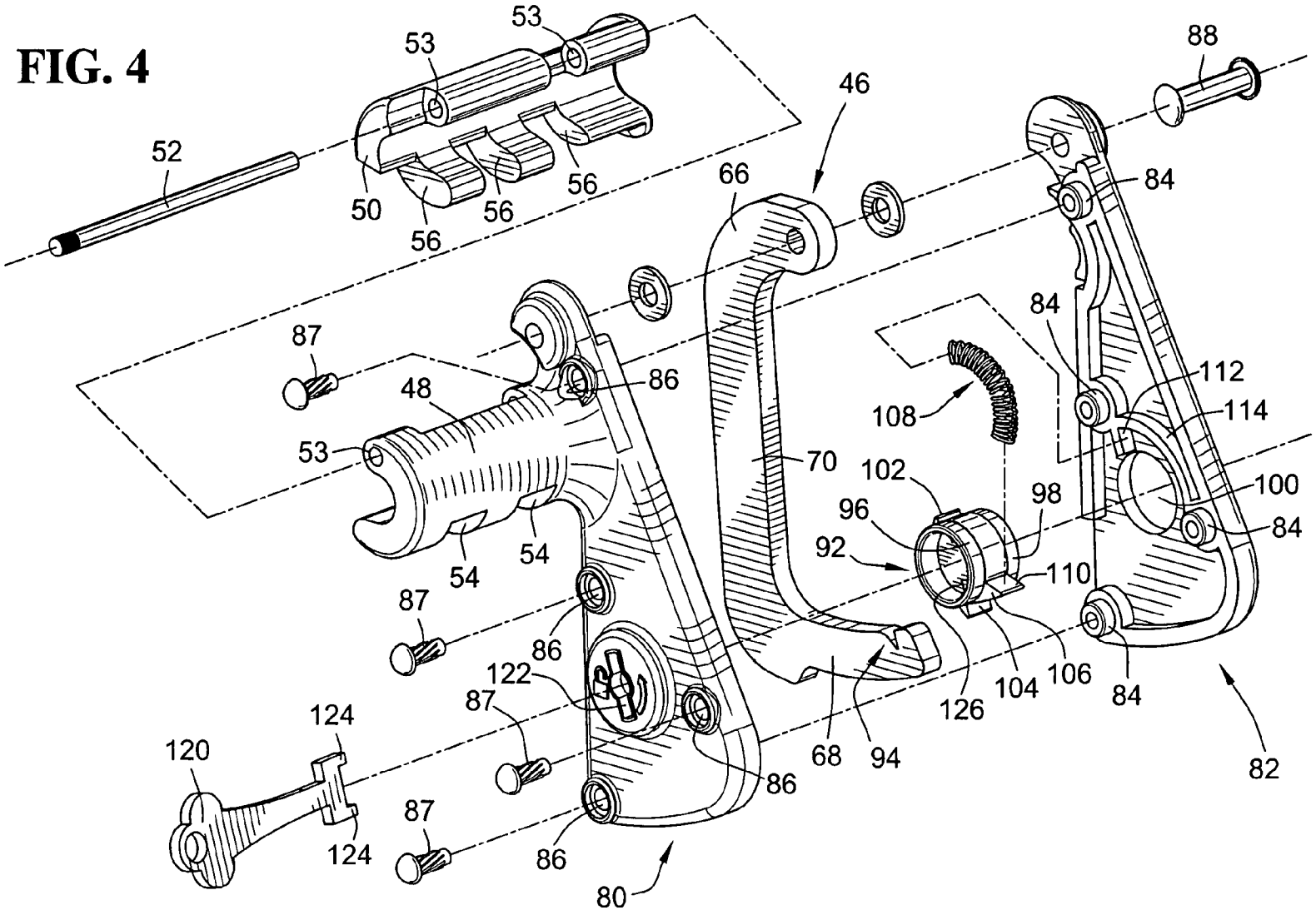
FIG. 4 is an exploded view of the display lock of FIG. 1.

As shown in FIG. 3, the clasp 42 is in an open position which allows the display lock 40 to be mounted onto the top bar 24 by positioning the top bar 24 between the two C-shaped members 48, 50. Once the top bar 24 is between the two C-shaped members 48, 50, the second C-shaped member 50 may be pivoted relative to the first C-shaped member 48 via hinge pin 52 to the closed position such that the C-shaped members 48, 50 surround the top bar 24. It should be appreciated that because the clasp 42 attaches to the top bar 24 in this manner that the display lock 40 does not need to be slid onto the top bar via an end of the top bar 24 but may be attached to the top bar 24 from a side and substantially anywhere along the length of the top bar 24. Furthermore, it should be appreciated that the clasp 42 acting through the C-shaped members 48, 50 is adapted to allow the display lock 40 to be selectively attached and detached from the top bar 24 without the use of any tools.

The clasp 42 extends in a forward direction from the lock body 44. Particularly, the clasp 42 extends from a front shell portion 80 of the lock body 44. The lock body 44 further includes a rear shell portion 82 that connects with and is substantially similar to the front shell portion 80. These shell portions 80, 82 are best manufactured from a molded plastic or cast metal. The two shell portions 80, 82 define an interior space therebetween. The rear portion 82 includes cylindrical posts 84 that receive corresponding holes 86 in the front portion 80. The posts 84 and holes 86 help properly align the front portion 80 with the rear portion 82 during assembly. The two shell portions 80, 82 are secured together using rivets 87 that extend through the holes 86 and cylindrical posts 84.

The lock body 44 is hingedly connected to the securing arm 46. The securing arm 46 is generally C-shaped and includes a top end portion 66, a bottom end portion 68 and an elongated vertically extending extension portion 70 disposed between and connecting the top and bottom end portions 66, 68. The securing arm 46 is preferably made from stamped steel, but can also be manufactured from a rigid plastic. The two end portions 66, 68 laterally extend from the extension portion 70 toward the lock body 44 to give the securing arm 46 its "C-shape." The top end portion 66 is pivotally connected to an upper portion of the lock body 44. Particularly, the top end portion 66 is secured between an upper portion of the front and rear shell portions 80, 82 by hinge pin 88.

As shown in FIG. 1, the securing arm 46 mates with the lock body 44 such that the securing arm 46 may be locked and/or secured relative to the lock body 44. In this embodiment, the bottom end portion 68 is receivable and selectively secured in a lower portion of the interior of the lock body 44. Particularly, the bottom end portion 68 inserts through a recess 90 defined between the two shell portions 80, 82 and into the interior of the lock body 44. A lock secures the bottom end portion 68 to and/or within the lower portion of the lock body 44. In this embodiment, the lock is a resiliently biased cylindrical tumbler 92 within the lock body 44 having a catch in the form of a tooth 104 that engages with a corresponding catch of the bottom end portion 68 in the form of a notch 94 in the bottom end portion 68 to selectively secure the bottom end portion 68 in the lock body 44. It will be appreciated that the corresponding catches of the bottom end portion and the tumbler could be in various forms of notches and teeth. In other words, the notch is not reserved to the bottom end portion and the tooth is not reserved to the tumbler.

The tumbler 92 includes two shoulder portions 96, 98 for pivotally mounting the tumbler 92 in the lock body 44. The shoulder portions 96, 98 are sized to be received in corresponding recesses 100 in the front and rear shell portions 80, 82.

The tumbler 92 includes three radially projecting teeth 102, 104, and 106. The teeth 102, 104, and 106 extend axially between the two shoulder portions 96, 98. Tooth 104 provides a corresponding catch that engages with notch 94 to restrain the securing arm 46. The tumbler 92 is resiliently biased by a spring 108. One end of spring 108 acts on surface 110 of tooth 106 to resiliently bias the tumbler 92 in a clockwise direction. The other end of spring 108 acts on a spring abutment wall 112 of the lock body 44. The spring abutment wall 112 is defined by two portions, one portion (not shown) projects rearward from the front shell portion 80 and a second portion 112 projects frontward from the rear shell portion 82. The spring 108 is positioned between and held in place by a portion of the outer surface of the tumbler 92 and a curved spring guide wall 114. Tooth 102 abuts with the opposite side of the abutment wall 112 as spring 108. Tooth 102 acts as a stop to limit the clockwise rotation of the tumbler 92. Clockwise is defined by looking in the rearward direction (from the front shell portion 80 to the rear shell portion 82). Particularly, the rotation of the tumbler 92 is limited such that tooth 104 cannot rotate in a clockwise direction beyond a vertically downward position (beyond 6 o'clock). This prevents the tumbler 92 from rotating too far in the clockwise direction such that tooth 104 would disengage notch 94 and allow the bottom end portion 68 to be removed from the lock body 44.

In operation, the display lock 40 is selectively movable between a locked condition (FIG. 1) and an unlocked condition (FIGS. 2 and 3). In the unlocked condition, as shown in FIG. 3, the display lock 40 may be attached to or removed from the top bar 24 of the display hook 40. Particularly, with the first and second C-shaped members 48, 50 of the clasp 42 in the open position, the display lock 40 is positioned such that the top bar 24 is between the first and second C-shaped members 48, 50. The second C-shaped member 50 is then pivoted about hinge pin 52 such that the C-shaped members 48, 50 define an aperture and surround the top bar 24, as shown in FIG. 2. At this point the clasp 42 is attached to the top bar 24, but the clasp 42 is not locked to the top bar 24. The display lock 40 may rotate about or slide linearly along the top bar 24. In the unlocked position, merchandise may be removed from the bottom bar 26 while the display lock 40 is attached to the top bar 24.

In the locked condition, the bottom end portion 68 of the securing arm 46 is inserted into the recess 90 of the lock body 44 and engaged with the tumbler 92 via the cooperating catches. Particularly, the tooth 104 of the tumbler 92 is engaged with notch 94 of the securing arm 46. As the bottom end portion 68 is inserted into recess 90, the bottom end portion 68 causes the tumbler 92 to rotate in a counter-clockwise direction compressing spring 108 between face 110 of tooth 106 and abutment wall 112 and allowing the bottom end portion 68 to be properly inserted into the lock body 44.

In this locked condition, the first end portion 66 of the securing arm 46 is at a higher vertical position than the top bar 24. The bottom end portion 68 of the securing arm 46 is at a vertical position below the bottom bar 26. The extension portion 70 is laterally spaced to the side of the top and bottom bars 24, 28. Thus, the securing member 46 surrounds a portion of the outer periphery of both the top bar 24 and the bottom bar 26. The lock body 44 is generally positioned to the opposite side of the top and bottom bars 24, 28. The combination of the securing arm 46 and the lock body 44 entirely surround or entrap the top and bottom bars 24, 26 therebetween. As illustrated in FIG. 1, in this locked condition, the combination of the securing arm 46 and the lock body 44 surround the bottom bar 26 such that merchandise 12 positioned between the rear mount 22 and the display lock 40 cannot be removed from the bottom bar 26. As further illustrated in FIG. 1, the display lock 40 may selectively divide the merchandise into a portion of merchandise 12 that is secured to the bottom bar 26 and a portion of merchandise 14 that is removable from the bottom bar 26.

In the locked condition, the securing arm 46 acts in combination with the clasp 42 to selectively lock the display lock 40 to the top bar 24, as shown in FIG. 1. While in the locked condition, a portion of the securing arm 46 partially surrounds the second C-shaped member 50 of clasp 42 and locks the two C-shaped members 48, 50 in the closed position and preventing the two C-shaped members 48, 50 from separating. In other words, the securing arm 46 prevents the second C-shaped member 50 from pivoting about hinge pin 52 to the open position (as shown in FIG. 3). The top bar 24 is thereby locked within the aperture defined between the first and second C-shaped 48, 50 members. The only way to remove the top bar 24 from the aperture defined by the C-shaped members 48, 50 is to move the display lock 40 to the unlocked condition by removing the securing member 46 from the lock body 44. As shown in FIG. 1, the lock body 44 and securing arm 46 prevent a portion of the merchandise 12 from being removed from the bottom bar 26 in the locked condition.

To selectively move the display lock to the unlocked condition, a key 120 may be used to bias the tumbler 92 in a counter-clockwise direction. Particularly, the key 120 is inserted through a slot 122 in the front shell portion 80. The key includes two prongs 124 that engage with two holes 126 in the side of the tumbler. This engagement allows the key 120 to rotate the tumbler 92 in the counter-clockwise direction. As the tumbler 92 is rotated in the counter-clockwise direction, tooth 104 disengages notch 94 and the securing arm 46 may be rotated about hinge pin 88 such that the bottom end portion 68 is removed from recess 90 of the lock body 44.

In an alternative embodiment, the C-shaped members would not include the interlocking fingers, but the bottom portion of the C-shaped members would terminate in a curved surface. The curved surface of one C-shaped member would abut with the curved surface of the other C-shaped member when the clasp is in the closed position. Furthermore, in this embodiment, it may be preferred to have the hinge pin connecting the two C-shaped members be sized significantly large relative to the holes in which it is inserted and a friction fit is created such that the two C-shaped members do not freely move relative to one another. In other words, it would take effort to rotate the C-shaped members relative to each other via the hinge. By preventing the two C-shaped members from freely rotating about the hinge pin, the clasp would more readily remain in the closed position and attached to the top bar when the display lock is in the unlocked condition.

Figure 5:
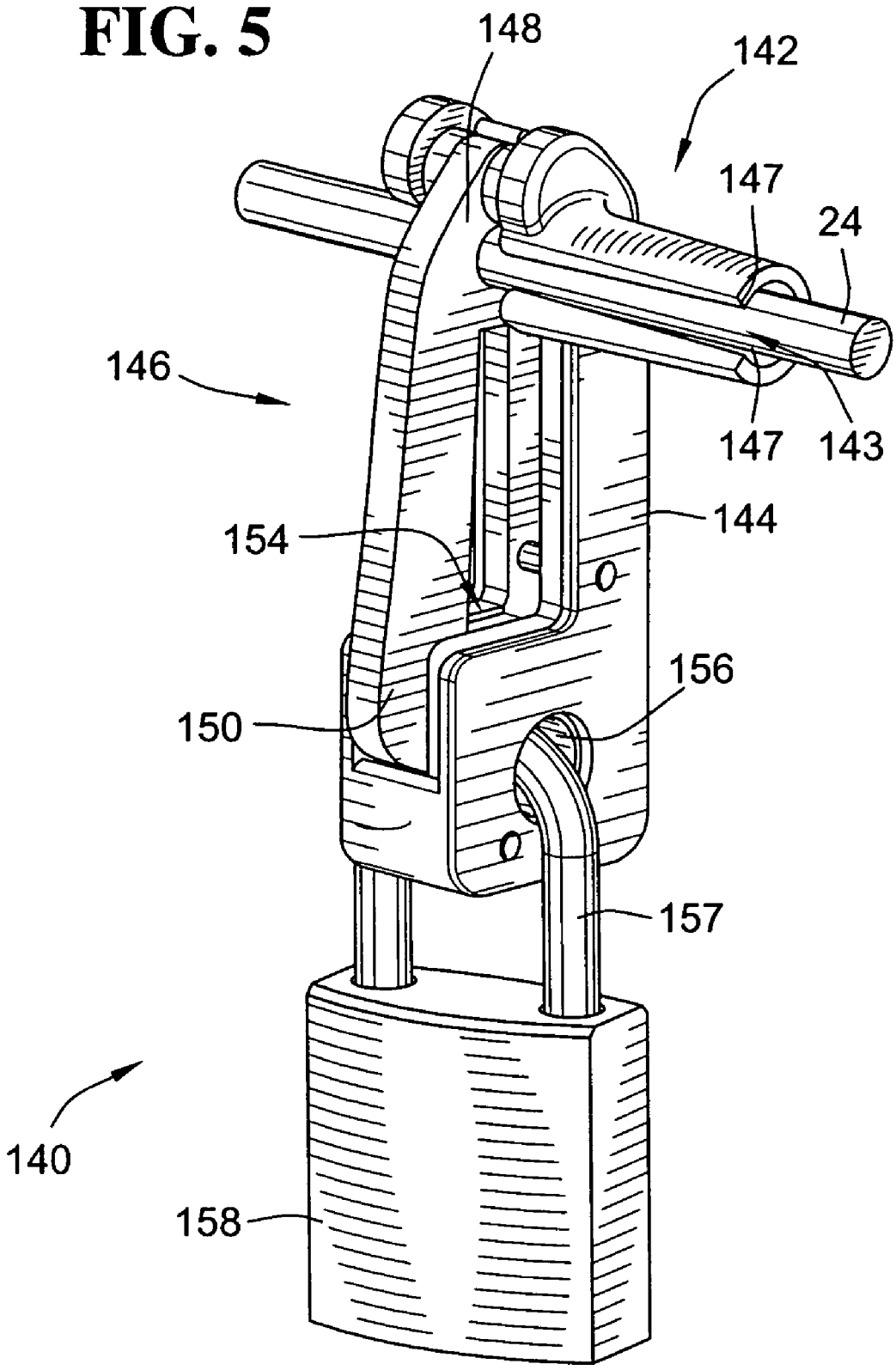
FIG. 5 is a perspective view of an alternative embodiment of the display lock of FIG. 1.

A further alternative embodiment is illustrated in FIG. 5. The display lock 140 functions significantly the same as that discussed previously. In this embodiment, the clasp 142 is defined by a channel 143. The channel 143 receives top bar 24. Lock body 144 is pivotally connected to a top end portion 148 of securing arm 146. The free ends 147 of the clasp 142 that define the channel 143 are curved resilient finger sized to snap fit around the top bar to attach the display lock 140 to the top bar 24. The securing arm 146 secures the top bar 24 within channel 144 as explained previously with the prior embodiment.

Furthermore, the bottom end portion 150 of the securing arm 146 includes an aperture (not shown) rather than the catch in the form of a notch. The lock body 144 includes a slot 154 sized to receive the bottom end portion 150 of the securing arm 146. The lock body 144 includes an aperture 156 that aligns with the aperture 152 of the securing arm 146 while the bottom end portion 150 of the securing arm 146 is inserted into the slot 154. Rather than including a tumbler to engage the securing arm 146, an arm 157 of a pad lock 158 is inserted through apertures the apertures in the securing arm 146 and the aperture in the lock body 156 to lock the securing arm 146 in the slot 154.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A display lock for selectively securing merchandise on a display hook, comprising:

a clasp adapted to mount onto the display hook;

a first member attached to the clasp, the first member having a first engagement portion;

a second member pivotally connected to the first member by a hinge, the second member having a second engagement portion adapted to mate with the first engagement portion, the first member pivoting relative to the second member through the hinge between a closed position in which the first and second engagement portions mate and an open position in which the first and second engagement portions are unmated; and a lock spaced apart from and moving independent of the pivotal connection between the first and second members, the lock having a locked condition maintaining the first and second engagement portions in the closed position, and an unlocked condition permitting relative movement of the first and second members to the open position.

2. The display lock of claim 1, wherein the lock is carried by and being movable relative to the first member, the lock having a catch, the second engagement portion having a coordinating catch engageable with the catch of the lock.

3. The display lock of claim 2, wherein the lock is a tumbler pivotal relative to the first member, the catch of the tumbler being a tooth, and the coordinating catch of the second engagement portion being a notch.

4. The display lock of claim 1, wherein the first engagement portion includes a first aperture, the second engagement portion includes a second aperture that aligns with the first aperture in the closed position, and the lock is a pad lock having a shackle adapted to be inserted through the first and second apertures.

5. The display lock of claim 1, wherein the clasp includes a first C-shaped member and a second C-shaped member hingedly connected to the first C-shaped member such that, in a closed position relative to each other, the first and second C-shaped members define an aperture therebetween.

6. The display lock of claim 5, wherein the second member secures the first and second C-shaped members in the closed position when the lock is in the locked condition.

7. The display lock of claim 1, wherein the clasp defines a channel and the second member partially closes the channel when the lock is in the locked condition.

8. The display lock of claim 1, further comprising a key adapted for substantially moving the lock from a locked condition to an unlocked condition.

9. A display lock for securing merchandise on a display hook having at least two bars, the display lock comprising:

a lock body having a locking mechanism;

an arm having a first end hingedly connected to an upper portion of the lock body and a second end adapted to mate with a lower portion of the lock body and having a catch portion engageable with the locking mechanism, the locking member being spaced apart from and moving independent of the hinged connection between the lock body and the arm, the display lock having a locked position in which the arm is mated with lock body and engaged with the locking mechanism and an unlocked position in which the second end is not mated with the lock body; and a clasp connected to at least one of the lock body and the arm, the clasp adapted to mount to the display hook.

10. The display lock of claim 9 wherein the clasp includes a first C-shaped member extending from the lock body and a second C-shaped member hingedly connected to the lock body such that, in a closed position relative to each other, the first and second C-shaped members define an aperture therebetween.

11. The display lock of claim 10 wherein the arm maintains the first and second C-shaped members in the closed position when the display lock is in the locked position.

12. The display lock of claim 11 wherein the first C-shaped member includes fingers sized to mesh with fingers of the second C-shaped member.

13. The display lock of claim 9 wherein the clasp defines a channel and the arm partially closes a portion of the opening of the channel while the display lock is in the locked position.

14. The display lock of claim 9 wherein the locking mechanism includes a tumbler pivotal relative to the lock body and having a corresponding catch engageable with the catch portion of the second end.

15. The display lock of claim 9 wherein the display lock further includes a key that is adapted to selectively disengage the locking mechanism from the arm such that the display lock can be moved from the locked position to the unlocked position.

16. The display lock of claim 9, wherein the second end of the arm includes an aperture and the locking mechanism includes a pad lock and the lock body includes a corresponding aperture, the lock having a shackle adapted to be inserted through the first and second apertures when the display lock is in the locked position.

17. A display lock system comprising:

a support, a display hook comprising a rear mount configured to attach the display hook to the support, at least two bars extending forwardly from the rear mount including a top bar and a bottom bar, the bottom bar parallel to and vertically disposed under the top bar, and a stop disposed on the top bar;

a display lock comprising a clasp disposed on the top bar, a lock body including a locking mechanism, and an arm connected to and movable relative to the lock body, the arm having a catch engaged with the locking mechanism in a locked position and the catch being disengaged from the locking mechanism in an unlocked position, in the locked position the arm being generally on a first side of the upper and lower bars and the lock body being on a second side opposite the first of the upper and lower bars; the lock body and arm entrapping the upper and lower bars therebetween in the locked position.

18. The display lock system of claim 17 further including merchandise carried on the bottom bar wherein the display lock is adapted to divide the merchandise into a first portion of merchandise and a second portion of merchandise, the first portion secured to the display hook between the display lock and the rear mount, and the second portion being free to be removed from the display hook.

19. The display lock system of claim 17 wherein the clasp includes a first C-shaped member extending from the lock body and a second C-shaped member hingedly connected to the lock body such that the C-shaped members in a closed position define an aperture therebetween, the aperture slidably and pivotally receiving the top bar.

20. The display lock system of claim 19 wherein the arm in the locked position is adapted to maintain the C-shaped members of the clasp in the closed position such that the clasp is secured to the top bar.

21. The display lock system of claim 17 wherein the clasp defines a channel, the arm adapted to secure the top bar in the channel when in the locked position.

22. The display lock system of claim 17 wherein the catch is a notch and the locking mechanism is a cylindrical tumbler having a tooth extending from an outer surface, the tooth engageable with the notch.

* * * * *